US005649649A

United States Patent [19]

Marelli

[11] Patent Number: 5,649,649

[45] Date of Patent: Jul. 22, 1997

[54] PUMP FOR DELIVERING ATOMIZED LIQUIDS

[75] Inventor: Andrea Marelli, Rozzano, Italy

[73] Assignee: Elettro Plastica S.p.A., Milan, Italy

[21] Appl. No.: 507,707

[22] Filed: Jul. 26, 1995

[30] Foreign Application Priority Data

Jan. 16, 1995 [IT] Italy ..... MI95A0065

[51] Int. Cl.[6] ..... B67D 5/42

[52] U.S. Cl. ..... 222/321.2; 222/321.1; 222/321.9

[58] Field of Search ..... 222/321.1, 321.2, 222/321.7, 321.8, 321.9, 341, 383.1, 385

[56] References Cited

U.S. PATENT DOCUMENTS

| | | | |
|---|---|---|---|
| 4,071,172 | 1/1978 | Balogh | 222/321.7 X |
| 5,192,006 | 3/1993 | Van Brocklin et al. . | |
| 5,224,471 | 7/1993 | Marelli et al. . | |
| 5,431,155 | 7/1995 | Marelli . | |
| 5,503,306 | 4/1996 | Knickerbocker | 222/321.1 X |
| 5,505,343 | 4/1996 | Knickerbocker | 222/321.1 |

FOREIGN PATENT DOCUMENTS

| | | | |
|---|---|---|---|
| 1428099 | 1/1966 | France . | |
| 2 075 783 | 1/1995 | Spain . | |
| 2179406 | 3/1987 | United Kingdom | 222/321.7 |

*Primary Examiner*—Andres Kashnikow
*Assistant Examiner*—Kenneth Bomberg
*Attorney, Agent, or Firm*—Oblon, Spivak, McClelland, Maier & Neustadt, P.C.

[57] ABSTRACT

A pump of very simple, low-cost structure include a hollow stem slidable within a cup-shaped body and acting as a compression piston, and a valving element housing an elongate rod movable in the cavity within the stem and provided with a conical collar which is urged by a spring to engage and seal against a conical seat within the stem, so that liquid delivery occurs snapwise when the conical collar disengages the conical seat within the stem.

1 Claim, 2 Drawing Sheets

PUMP FOR DELIVERING ATOMIZED LIQUIDS

BACKGROUND OF THE INVENTION

1. Field of the Invention

This invention relates type to a pump for delivering pressurized liquids, the delivery being of snap-start to prevent liquid dripping.

2. Discussion of the Background

Many types of pumps applicable to liquid containers are known, operable manually to deliver the liquid in atomized form.

For optimum operation, the pump must ensure that the liquid is delivered only under pressure (hence preventing dripping, which would occur if the pressure of the delivered liquid were to fall below a predetermined minimum value) and allow easy pump priming on initial use.

These requirements are satisfied only by pumps of complicated structure and hence high cost. Low-cost pumps do exist, but these do not achieve the aforesaid results.

SUMMARY OF THE INVENTION

The main object of the present invention is therefore to provide a pump of the stated type which is of very simple structure and low production cost, which ensures snap-start of liquid delivery, and which allows easy pump priming on initial use.

This and further objects are attained by a pump comprising an elongate cup-shaped body having at one end a hollow appendix connectable to a dip tube, a hollow piston slidable under sealed conditions within said cup-shaped body and having a hollow appendix emerging from the cup-shaped body and acting as a stem for mounting a delivery cap thereon, a spring for urging said piston out of the cup-shaped body towards and against a stop element rigid with the cup-shaped body and provided with means for fixing the pump onto the mouth of a container containing liquid to be delivered by the pump, a floating member for closing the cavity within the cup-shaped body in proximity to its hollow appendix and a movable valving element cooperating with said piston to open or close its mouth towards the cup-shaped body as a result of operating the pump, characterized in that said valving element consists of an elongate rod extending along the cavity within said piston and emerging from it into the cup-shaped body, said rod having its projecting portion shaped as a conical surface coaxial with the rod itself and with its vertex facing the interior of the cup-shaped body, an inner portion of the cavity within said piston being defined by a conical surface complementary to that of the shaped portion of said rod on which there acts a spring housed within the piston and acting between the rod and the piston to urge the conical surface of the shaped portion of the rod towards and against the conical surface of the piston, the length of said rod being such that its free end within the cup-shaped body rests on and presses against said movable member when said piston is in its position of maximum lowering within said cup-shaped body.

Preferably the outer free end of said rod is housed within and movable in contact with the grooved surface of a hole provided in the discharge end of said stem.

BRIEF DESCRIPTION OF THE DRAWINGS

The structure and characteristics of the pump will be more apparent from the description of a preferred embodiment thereof, given hereinafter by way of non-limiting example with reference to the accompanying drawings in which.

DESCRIPTION OF THE PREFERRED EMBODIMENTS

Figure 1:
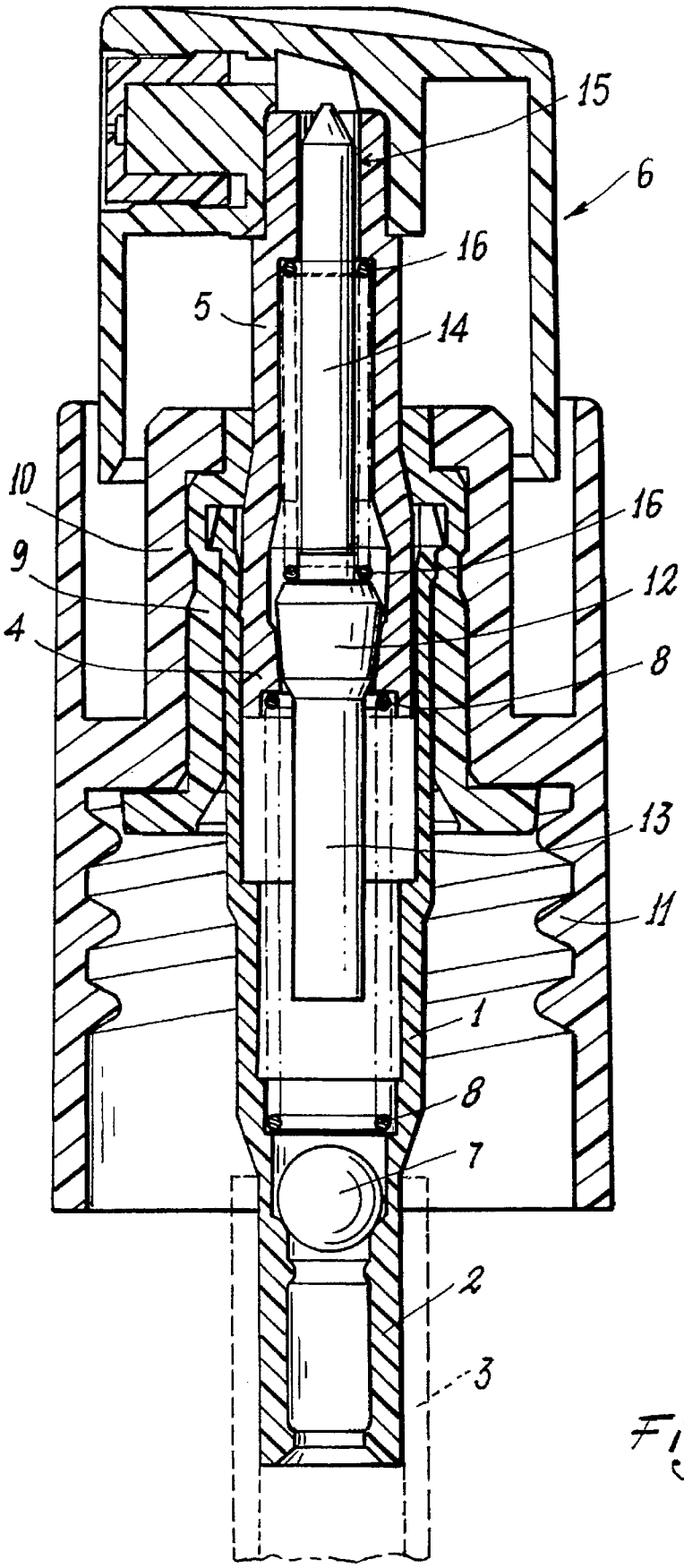
FIG. 1 is a longitudinal sectional through the pump in its rest state.

The pump shown in the figures comprises an elongate cup-shaped body 1 from which there extends a hollow appendix 2 on which one end of a dip tube 3 (shown by dashed lines on the drawings) can be mounted, its other end being immersed in the liquid contained in the container (not shown for simplicity) on which the pump has been previously mounted.

The cup-shaped body 1 defines a cylindrical cavity housing a hollow piston 4 which is slidable under sealed conditions therein and from which there extends a hollow appendix 5 emerging from the cup-shaped body and acting as a stem on which a delivery cap 6 of known structure is mounted.

The cup-shaped body houses in its interior a floating ball 7 (for closing the mouth of the hollow appendix 2) and a spring 8 which urges the piston 4 upwards (with respect to the figures). Escape of the piston 4 from the cavity within the cup-shaped body 1 is prevented by an inner ring cap 9 fixed to the cup-shaped body and secured to an outer ring cap 10, from the lower end of which there extends a cylindrical skirt 11 provided with an internal thread by which the pump can be fitted to the mouth of a bottle containing the liquid to be delivered.

The structure of the two ring caps 9, 10, and the manner in which they are connected together is known and can be different from that shown on the drawings.

The cavity within the piston 4 houses a valving element consisting of a conical body 12 projecting from an elongate rod, one portion 13 of which extends into the cavity within the cup-shaped body 1 towards the ball 7, and the other portion 14 of which extends along the cavity within the appendix 5 of the piston, to pass through a hole provided in the free end of said appendix 5. The outer surface of the rod portion 14 is in light contact with the hole in the appendix 5, where small longitudinal channels 15 are provided to enable the pressurized liquid to flow into the delivery cap 6 and then into the external environment.

The conical body 12 of the valving element is urged by a spring 16 against a conical seat (complementary to the conical surface of the body 12) provided in proximity to the lower end (with respect to the figures) of the cavity within the piston 4.

To explain the pump operation it will be assumed that the pump is in the rest state shown in FIG. 1, that the pump is mounted on the mouth of a bottle containing a liquid to be delivered (into which the dip tube 3 dips), and that the cavity within the cup-shaped body 1 is filled with liquid, ie that the pump has already been primed.

When the delivery cap 6 is pressed with a finger, the liquid present in the cup-shaped body below the piston 4 is immediately put under pressure. A fact of maximum importance is that the conical surface of the body 12 engages under considerable friction the opposing conical surface of the seat provided in the piston 4, so that the valving element 12 becomes suddenly released from the piston only when the liquid pressure exceeds a predetermined value. As a result, the liquid can be delivered by the pump (which in practice undergoes "snap" opening, this being sensed by the finger when operating the pump) only at high pressure, so preventing the liquid being able to drip (and hence without being atomized) from the delivery cap.

It can be seen that the portion 14 of the rod fills practically the entire cavity within the appendix 5, so that the liquid quantity remaining trapped in the pump above the valving element is negligible.

It can also be seen that the translational movement of the rod portion 14 in contact with the end hole in the appendix 5 keeps the surface clean by preventing the formation of incrustation if the liquid carries solidifiable substances, such as hairspray.

The purpose of the rod portion 13 projecting towards the ball 7 is to allow easy pump priming on initial operation.

To clarify this, it will be assumed that the pump is still in the state shown in FIG. 1, but with only air present within the cup-shaped body.

On lowering the piston 4 within the cup-shaped body the air present therein is compressed, however this pressure is insufficient to disengage the conical surface of the body 12 from the opposing conical surface of the piston sealing seat against which the body 12 is urged by the spring 16.

Figure 2:
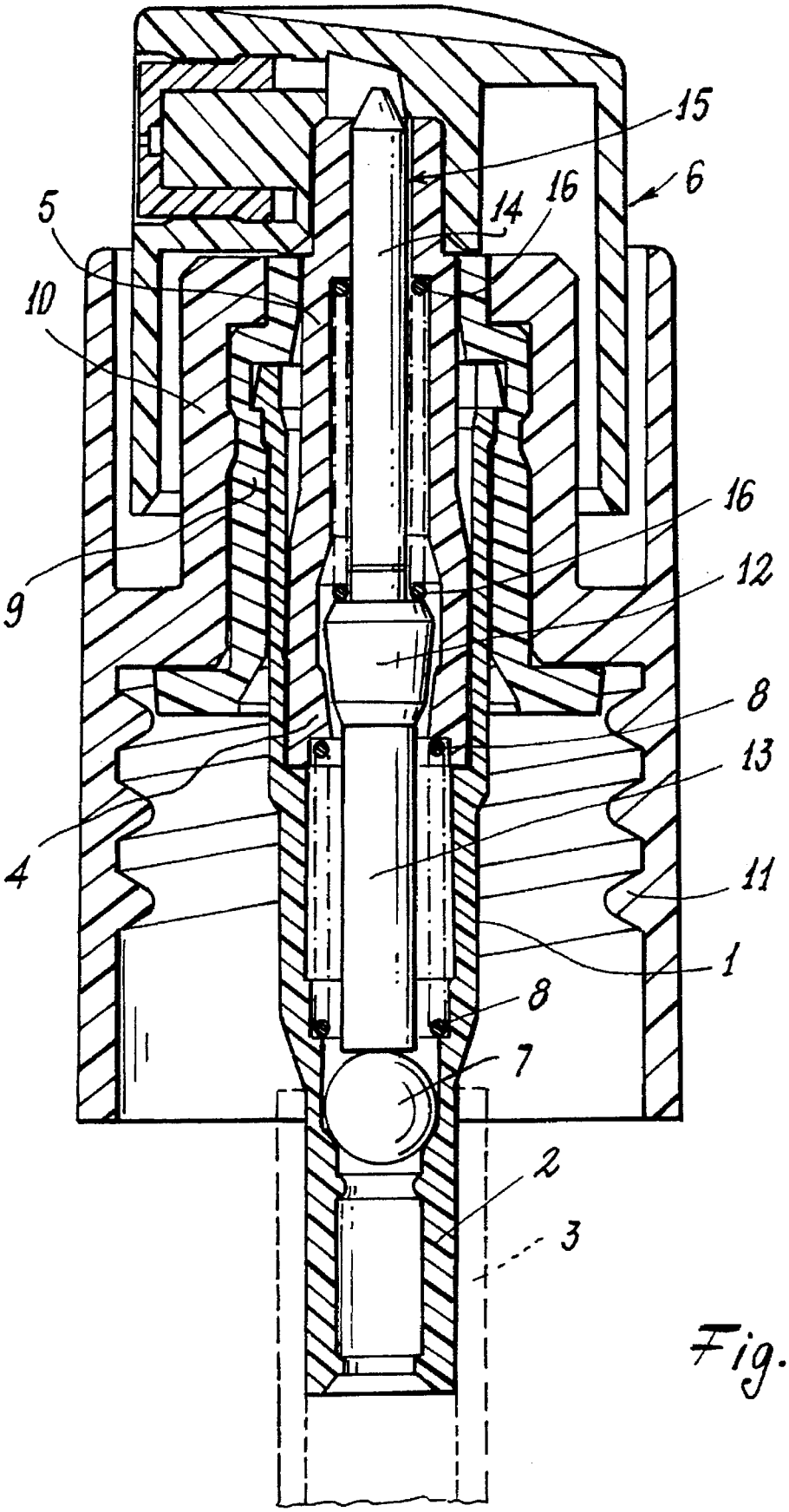
FIG. 2 is a longitudinal section through the pump in its primed state, ie of maximum lowering of the pump stem.

Just before the piston 4 reaches the end of its lowering stroke (FIG. 2), the free end of the rod portion 13 makes contact with the ball 7, then halting the movement of the rod (and of the valving element), whereas the piston continues its movement for a short distance.

The two conical sealing surfaces are hence separated from each other (FIG. 2) and the compressed air escapes to the outside of the cup-shaped body, while the ball remains pressed in order to close the aperture in the appendix 2.

When the delivery cap is released, the piston 4 first rises within the cup-shaped body (under the thrust of the spring 8) until the two said conical surfaces come into mutual contact, after which the piston continues to rise together with the valving element (towards the position of FIG. 1), hence causing a vacuum to form within the cup-shaped body. This vacuum causes the liquid to rise into the cup-shaped body (via the appendix 2 and around the ball 7), so that the pump is easily primed, as is clearly apparent.

Obviously, numerous modifications and variations of the present invention are possible in light of the above teachings. It is therefore to be understood that within the scope of the appended claims, the invention may be practiced otherwise than as specifically described herein.

I claim:

1. A pump delivering pressurized liquids, comprising:

an elongate cup-shaped body having at one end a hollow appendix connectable to a dip tube, a hollow piston slidable under sealed conditions within said cup-shaped body and having a hollow appendix emerging from the cup-shaped body and acting as stem mounting a delivery cap thereon, a spring urging said piston out of the cup-shaped body towards and against a stop element rigid with the cup-shaped body and provided with a mechanism fixing the pump onto a mouth of a container containing liquid to be delivered by the pump, a floating member closing a cavity within the cup-shaped body in proximity to a hollow appendix thereof and a movable valving element cooperating with said piston to open or close a mouth thereof towards the cup-shaped body as a result of operating the pump, said valving element comprising an elongate rod extending along a cavity within said piston and emerging from said cavity into the cup-shaped body, said rod having a projecting thereof portion, and an inner portion of the cavity within said piston being defined by a conical surface complementary to that of a shaped portion of said rod wherein a spring is housed within the piston and acts between the rod and the piston to urge the conical surface of the shaped portion of the rod towards and against the conical surface of the piston, a length of said rod being such that a free end thereof within the cup-shaped body rests on and presses against a movable member when said piston is in a position of maximum lowering within said cup-shaped body wherein an outer free end of said rod is housed within and movable in contact with a grooved surface of a hole provided in a discharge end of said stem.

* * * * *